US006581337B1

(12) United States Patent
Skov et al.

(10) Patent No.: US 6,581,337 B1
(45) Date of Patent: Jun. 24, 2003

(54) MODULAR ENCLOSURE

(75) Inventors: Erik L. Skov, Akron, OH (US); David A. Bird, Akron, OH (US); John F. Travers, North Royalton, OH (US); Kenneth F. Clausen, Doylestown, OH (US); Jonathan N. Mandel I, Gurnee, IL (US); Laura M. Marker, Akron, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 09/905,653

(22) Filed: Jul. 13, 2001

Related U.S. Application Data

(60) Provisional application No. 60/219,586, filed on Jul. 20, 2000.

(51) Int. Cl.[7] ..... E04H 1/00

(52) U.S. Cl. ..... 52/79.5

(58) Field of Search ..... 52/79.1, 79.5, 52/270, 264, 262, 274, 588.1

(56) References Cited

U.S. PATENT DOCUMENTS

| | | | | |
|---|---|---|---|---|
| 603,147 A | | 4/1898 | Lordly | 189/36 |
| 2,079,635 A | | 5/1937 | Sharp | 52/764 X |
| 2,270,161 A | | 1/1942 | Briggs | 189/2 |
| 2,981,383 A | | 4/1961 | Dunn | 189/36 |
| 3,070,646 A | | 12/1962 | Lindgren | 174/35 |
| 3,381,430 A | | 5/1968 | Wiczer | 52/282 |
| 3,436,881 A | | 4/1969 | Schlecht | 52/90 |
| 3,452,501 A | | 7/1969 | Zimmer et al. | 52/625 |
| 3,513,608 A | | 5/1970 | Nagrod | 52/82 |
| 3,516,216 A | | 6/1970 | Galloway | 52/731 |
| 3,543,456 A | | 12/1970 | Gregoire | 52/92 |
| 3,638,385 A | | 2/1972 | Nobels et al. | 52/665 |
| 3,640,039 A | | 2/1972 | McKee et al. | 52/281 |
| 3,675,380 A | | 7/1972 | Moss | 52/80 |
| 3,751,865 A | * | 8/1973 | Brigham | 52/474 |
| 3,820,299 A | | 6/1974 | Verholt | 52/753 |
| 3,854,269 A | | 12/1974 | Hancook | 52/754 |

(List continued on next page.)

FOREIGN PATENT DOCUMENTS

| | | | |
|---|---|---|---|
| CH | 396368 | 1/1966 | |
| DE | 2643270 | 3/1978 | 52/282.2 |
| DE | 3418687 | 11/1985 | 52/264 |
| EP | 0 359 309 B1 | 9/1989 | |
| EP | 0 359 309 A2 | 9/1989 | |
| FR | 1028791 | 5/1953 | |
| FR | 1311988 | 11/1962 | |
| FR | 1447663 | 6/1966 | 52/264 |
| GB | 1081423 | 8/1967 | |
| GB | 1 262 395 | 2/1972 | |
| GB | 2115452 A | 9/1983 | |
| GB | 2 176 514 A | 12/1986 | |
| GB | 2281326 A | 3/1995 | |
| IR | 22203 | 7/1959 | |

OTHER PUBLICATIONS

"Item Industrietechnik" promotional materials, bearing a designation "0.4.106.31 5/95".

*Primary Examiner*—Ramon O. Ramirez
(74) *Attorney, Agent, or Firm*—Marshall, Gerstein & Borun

(57) ABSTRACT

A modular enclosure including first channels and a plurality of second and third channels which intersect the first channel at an angle, and a plurality of panels, each including a wall member and edge members pivotally coupled to the wall member. The wall members are configured to engage the first channel and the edge members are configured to engage the second and third channels. A method of assembling a modular enclosure is also disclosed, including providing a base including first channels, second channels, and third channels, providing a plurality of side panels each having a wall member and a first and second edge member pivotally coupled to the wall member, pivoting the first and second edge members so that they are non-parallel to the wall member, and inserting the wall members into the first channel, the first edge member into second channels, and the second edge members into third channels.

29 Claims, 18 Drawing Sheets

U.S. PATENT DOCUMENTS

| | | | | |
|---|---|---|---|---|
| 3,866,381 | A | 2/1975 | Eschbach et al. | 52/731 |
| 3,992,839 | A | 11/1976 | LaBorde | 52/275 |
| 4,258,519 | A | 3/1981 | Hugens | 52/282 |
| 4,294,051 | A | 10/1981 | Hughes, Jr. | 52/98 |
| 4,447,099 | A | 5/1984 | French et al. | 312/257 R |
| 4,557,091 | A | 12/1985 | Auer | 52/282 |
| 4,652,170 | A | 3/1987 | Lew | 403/381 |
| 4,805,365 | A | 2/1989 | Bastian | 52/282 |
| 5,036,634 | A | 8/1991 | Lessard et al. | 52/79.1 |
| 5,155,961 | A | 10/1992 | Bardo | 52/646 |
| 5,331,778 | A | 7/1994 | Mazpule et al. | 52/79.5 |
| 5,398,909 | A | 3/1995 | Sandwith | 52/731 X |
| 5,529,423 | A | 6/1996 | Burke et al. | 403/218 |
| 5,575,119 | A | 11/1996 | Wolfowitz | 52/79.1 |
| 5,592,794 | A | 1/1997 | Tundaun | 52/220.7 |
| 5,647,181 | A | 7/1997 | Hunts | 52/282.1 |
| 5,664,380 | A | 9/1997 | Hsueh | 52/775 X |
| 5,673,523 | A | 10/1997 | Carcedo et al. | 52/731.5 X |
| 5,813,738 | A | 9/1998 | Cheng | 312/263 |
| 5,864,997 | A | 2/1999 | Kelly | 52/282.2 |

* cited by examiner

MODULAR ENCLOSURE

CROSS-REFERENCE TO RELATED APPLICATIONS

The present invention claims priority under 35 U.S.C. §119 from U.S. Provisional Patent Application No. 60/219,586 titled "MODULAR ENCLOSURE" filed Jul. 20, 2000, the full disclosure of which is hereby incorporated by reference.

FIELD OF THE INVENTION

The invention relates to an enclosure and more particularly to a modular enclosure.

BACKGROUND OF THE INVENTION

Storage enclosures such as sheds are generally used for storing items such as lawn care tools and equipment, recreational equipment, athletic equipment, and the like. Such storage enclosures typically include a set of walls, a door, a floor, and a roof. The walls, roof, or floor may be formed by assembly and attachment of a plurality of separate panels using fasteners such as screws, bolts, nails, and pins.

Known storage enclosures have several disadvantages. For example, many known storage enclosures require a substantial amount of time, labor, planning, and skill to install, configure, and reconfigure (if reconfigurable at all). Additionally, known methods of coupling adjacent panels to form walls or the roof are destructive or invasive to the components themselves, making the sheds difficult to modify or rearrange. Such problems may discourage use, reconfiguration, and reorganization of the sheds and associated organizational devices.

To provide an inexpensive, reliable, and widely adaptable technique of assembling a modular storage assembly that avoids the above-referenced and other problems, would represent a significant advance in the art.

SUMMARY OF THE INVENTION

A primary feature of the present invention is to provide an inexpensive, easy-to-manufacture, and aesthetically pleasing storage enclosure that overcomes the above-noted disadvantages.

Another feature of the present invention is to provide structural components for a storage enclosure (such as walls, roof, etc.) that are relatively quickly and easily assembled and disassembled, configured or reconfigured, and the like.

Another feature of the present invention is to provide a storage enclosure that is lightweight and yet provides suitable strength and rigidity as a storage enclosure or as a display panel.

Another feature of the present invention is to provide attachment interfaces for a wide variety of modular organizational devices or other accessories that reduce manufacturing assembly costs in many applications, and that are quickly and easily reconfigurable.

How these and other advantages and features of the present invention are accomplished (individually, collectively, or in various subcombinations) is described in the following detailed description of the preferred and other exemplary embodiments, taken in conjunction with the Figures. Generally, however, they may be accomplished in a modular enclosure comprising a base including a first channel and a plurality of second channels non-parallel to the first channel, and a plurality of panels, each including a wall member and a first edge member pivotally coupled to the wall member. The wall members are configured to engage the first channel and the edge members are configured to engage the second channels.

These and other advantages and features of the present invention may also be accomplished in a modular enclosure comprising a base including a first channel and a second channel non-parallel to the first channel, a first panel including a first wall member and a first edge member pivotally coupled to the first wall member, and a second panel including a second wall member and a second edge member pivotally coupled to the second wall member. The first and second wall members engage the first channel and the first and second edge members engage the second channel.

These and other advantages and features of the present invention may further be accomplished in method of assembling a modular enclosure comprising providing a base including a first channel, a second channel, and a third channel, providing a plurality of side panels each having a wall member and a first and second edge member pivotally coupled to the wall member, pivoting the first and second edge members non-parallel to the wall member, and inserting the wall members into the first channel, the first edge member into the first channel, and the second edge member into the third channel.

The present invention further relates to various features and combinations of features shown and described in the disclosed embodiments. Other ways in which the objects and features of the present invention are accomplished will be described in the following specification or will become apparent to those skilled in the art after they have read this specification. Such other ways are deemed to fall within the scope of the present invention if they fall within the scope of the claims which follow.

DETAILED DESCRIPTION OF PREFERRED AND OTHER EXEMPLARY EMBODIMENTS

Before proceeding to the detailed description of the preferred and exemplary embodiments, several comments can be made about the general applicability and the scope thereof.

First, the exemplary embodiments described herein are configured to provide an inexpensive and efficient enclosure for manufacturing, shipping, storing, displaying, assembling, reconfiguring and modifying a modular storage enclosure. The modular storage enclosure may be sold as a kit or the individual structural components may be sold separately (i.e., "a la carte") so that the consumer may purchase the appropriate components according to his or her desired dimensional and accessory configuration, for repair or replacement, or for reconfiguration of an existing storage enclosure.

Second, while the components of the disclosed embodiments will be illustrated as a shed, the features of the disclosed embodiments have a much wider applicability. For example, the accessory mounting interface design can be used for other storage devices, units, enclosures, boxes, bins, storage containers, camping or other outdoor recreation enclosures, and other office or home organization and storage enclosures. Further, the size and outer dimensions of the various components including the wall panels in addition to the overall storage enclosure can be widely varied. As described herein, the wall members of each side panel are approximately two feet so that modular enclosures may be configured in two foot increments, such as six foot by six foot, six foot by eight foot, ten foot by eight foot, ten foot by ten foot, etc.

Third, the particular materials used to construct the exemplary embodiments are also illustrative. For example, blow molded high density polyethylene is the preferred material and method for making the panels, roof, and doors, but other materials can be used, including other thermoplastic resins such as structural foam polymers, polypropylene, acrylonitrile butadiene styrene ("ABS"), polyurethane, nylon, PVC, composite materials, any of a variety of homopolymer plastics, copolymer plastics, plastics with special additives, filled plastics, etc. Also, other molding operations may be used to form these components, such as extrusion, injection molding, vacuum or pressure molding, casting, rotational molding, etc. Alternatively, the panels and/or connectors may be made from other materials including metal, wood, aluminum, and the like.

Figure 1:
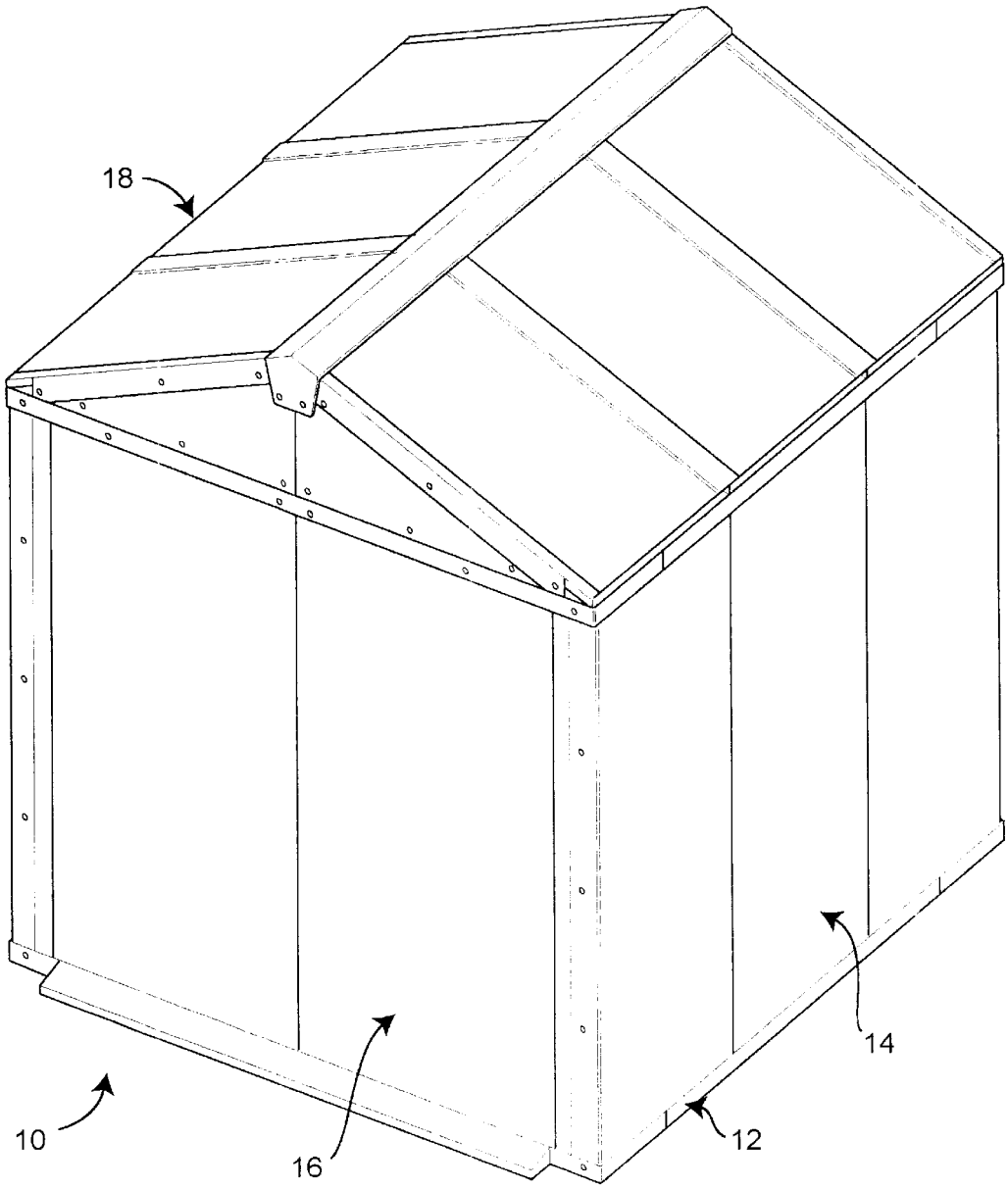
FIG. 1 is a perspective view of a modular enclosure according to a preferred embodiment.

Proceeding now to descriptions of the preferred and exemplary embodiments, FIG. 1 is an exploded perspective view of a storage enclosure 10 according to an exemplary embodiment. Storage enclosure 10 is shown as a modular structure that includes a floor assembly 12, a wall assembly 14, a door assembly 16, and a roof assembly 18. Floor assembly 12 forms a perimeter or a footprint for storage enclosure 10, and includes a plurality of floor panels. According to a preferred embodiment, floor panels are coupled by interlocking teeth which provide a snap-fit engagement when assembled. According to an alternative embodiment, floor panels include interfaces that are coupled together using any of a variety of fasteners.

FIG. 1 is a perspective view of modular enclosure 10 according to an exemplary embodiment. Modular enclosure 10 is configured to be inexpensive and convenient for manufacture, shipping, storage, display, and assembly. Modular enclosure 10 may be sold as a kit according to a specified dimension, or the individual structural components may be may be sold separately (i.e., "a la carte") so that the consumer purchases the appropriate structure components according to his or her desired dimensional and accessory configuration.

Modular enclosure 10 includes a base 12, a wall assembly 14, a door assembly 16, and a roof assembly 18. According to a preferred embodiment, modular enclosure 10 is assembled by arranging base 12 according to the desired configuration of the perimeter or footprint. Wall assembly 14 is then coupled to base 12. Door assembly 16 and roof assembly 18 are then coupled to wall assembly 14.

Figure 2:
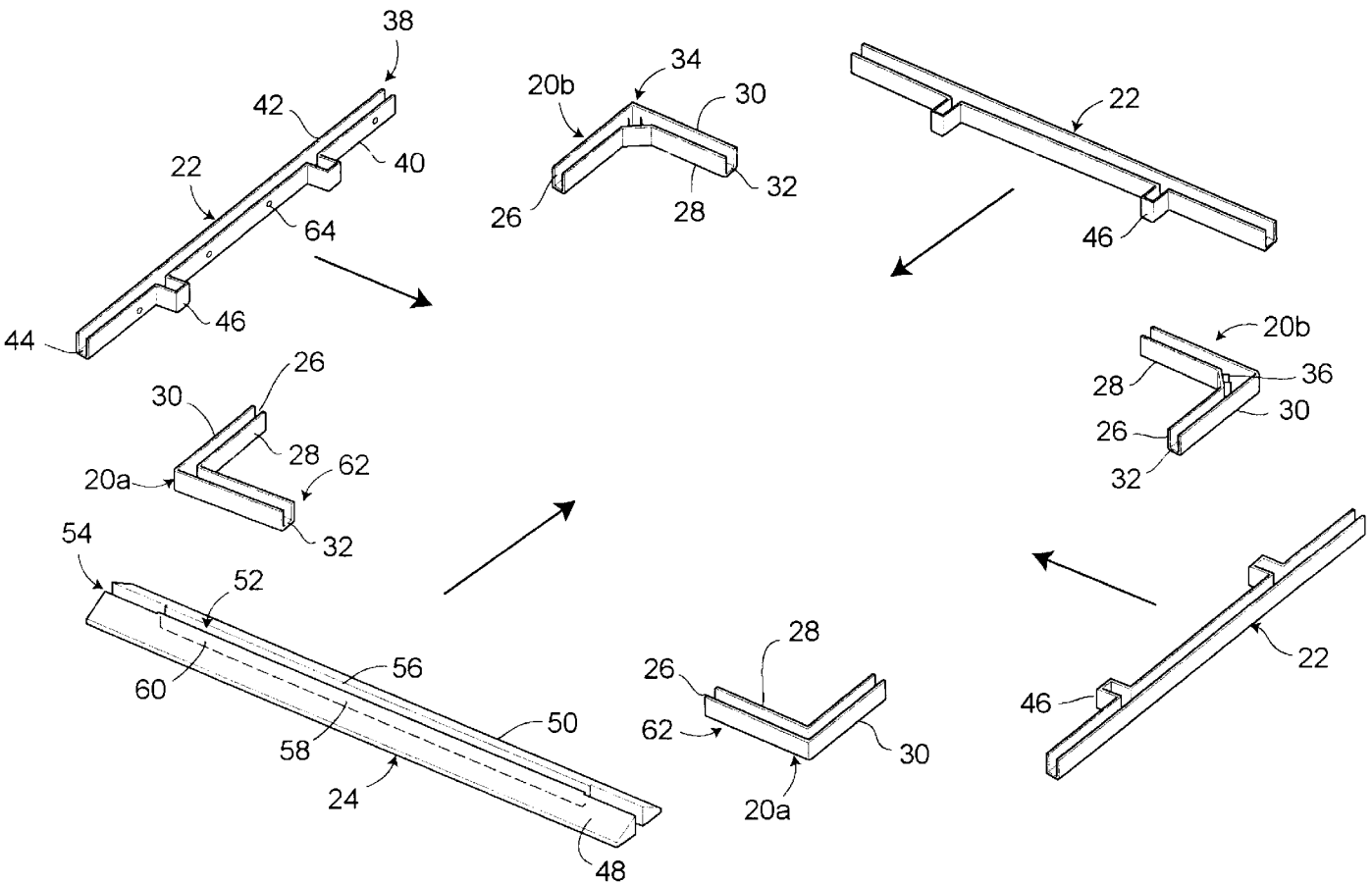
FIG. 2 is an exploded perspective schematic block flow diagram of a base assembly for the modular enclosure of FIG. 1 according to a preferred an exemplary embodiment.

FIG. 2 is an exploded perspective view of base 12 which forms a perimeter or footprint for modular enclosure 10. Base 12 includes a plurality of segments (shown as front and rear base corners 20*a,* 20*b,* base spacers 22, and a threshold 24).

Each base corner 20*a,* 20*b* includes a channel 26 that is generally U-shaped. Channel 26 is defined by an upwardly extending inner flange 28 and an upwardly extending outer flange 30 connected by a web 32. Inner flange 28 in rear base corner 20*b* includes a second channel or socket 34 formed by a pair of ribs 36. According to alternative embodiments, socket 34 is formed by any of a variety of arrangements such as slots molded or cut into inner flange 28, a series of integrally molded flanges, etc. According to an exemplary embodiment, socket 34 extends between opposing channels 26 on corners 20*a,* 20*b*. According to a preferred embodiment, socket 34 extends approximately 135° from channel 26. In alternative embodiments, socket 34 is merely non-parallel to channel 26.

Each base spacer 22 includes a channel 38 that is generally U-shaped. Channel 38 is defined by an upwardly extending inner flange 40 and an upwardly extending outer flange 42 connected by a web 44. Inner flange 40 includes a socket 46. According to a preferred embodiment, socket 46 is generally perpendicular to channel 38. In alternative embodiments, socket 46 is merely non-parallel to channel 38.

Threshold 24 is configured to provide a ramped structural surface at the entrance of modular shed 10. Threshold 24 includes a first ramp surface 48, a second ramp surface 50, a first channel 52, and a second channel 54. First channel 52 is defined by an inner wall 56 and an outer wall 58 connected by a web 60. The length of first channel 52 is approximately equal to the length of base spacers 22 so that base 12 is substantially square.

Base section 12 is assembled by positioning base corners 20*a,* 20*b* and base spacers 22 adjacent to one another. Threshold 24 is coupled to front base corner 20*a* by an engagement between one end 62 of each front base corner 20*a* and second channel 54. The ends 62 of front base corner 20*a* are positioned adjacent to the outer ends of the first channel 52.

Webs 32, 44, 60 include a plurality of apertures 64 so that base section 12 is anchored or attached to a supporting surface or floor 66. Floor 66 may be any of a variety of configurations such as a concrete slab, wood, earth, gravel, or the like. Base 12 is coupled to floor 66 by any of a variety of fasteners or devices (e.g., screws, bolts, stakes, pins, etc.). Additionally, apertures 64 allow water to drain from base corner 20, base spacers 22, and threshold 24.

FIGS. 3–10 are perspective views showing the assembly of wall assembly 14. Wall assembly 14 is made of a plurality of side panels 68 coupled to adjacent side panels 68. Wall assembly 14 is coupled to base section 12, and roof assembly 18. Side panels 68 include surface detail that is decorative and/or functional. For example, the surface detail is configured to provide a wood grain appearance to side panel 68, and/or configured to channel water away from the interface of adjacent side panel 68.

Figure 3:
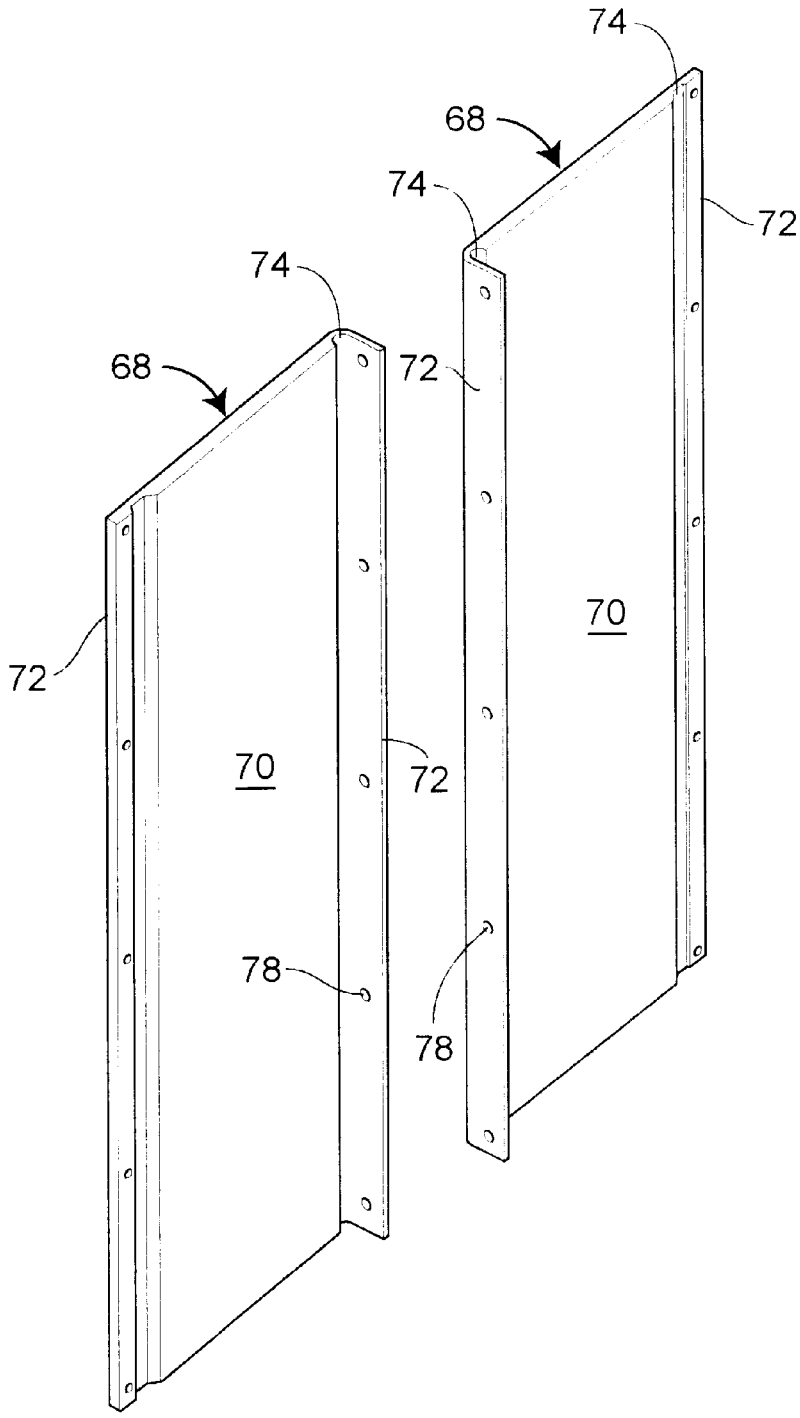
FIG. 3 is an exploded perspective view of a pair of panels for the modular enclosure of FIG. 1.
Figure 4:
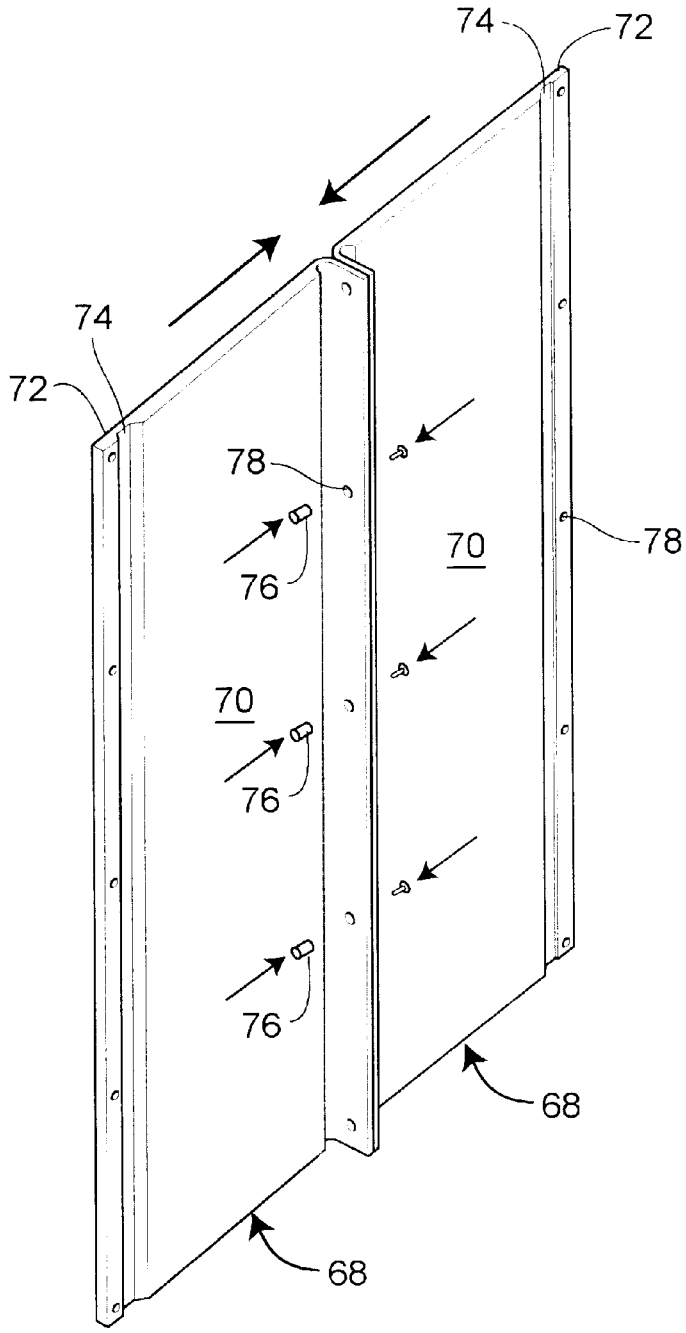
FIG. 4 is a perspective view of the panels of FIG. 3.
Figure 8:
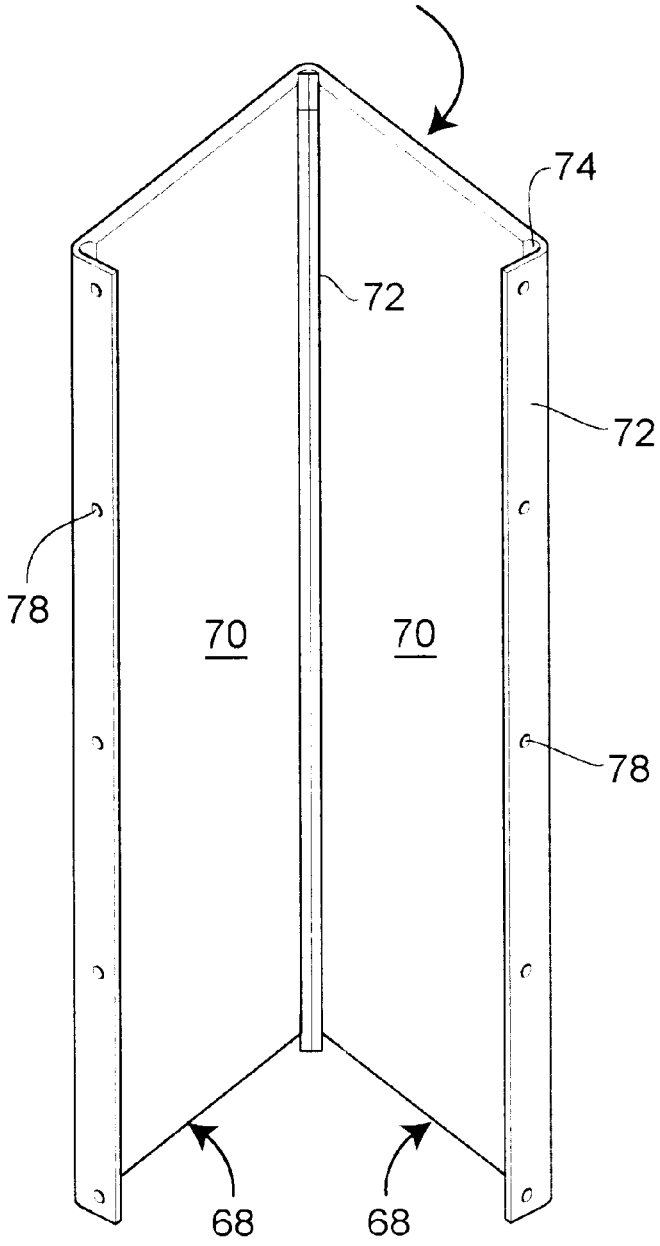
FIG. 8 is a perspective view of a pair of panels forming a corner.

FIGS. 3, 4, and 8 are perspective views of a pair of side panels 68 for wall assembly 14 of modular enclosure 10. Each side panel 68 includes a wall structure or member 70 and a side edge member 72 connected to wall member 70 by a living hinge 74.

Figure 6:
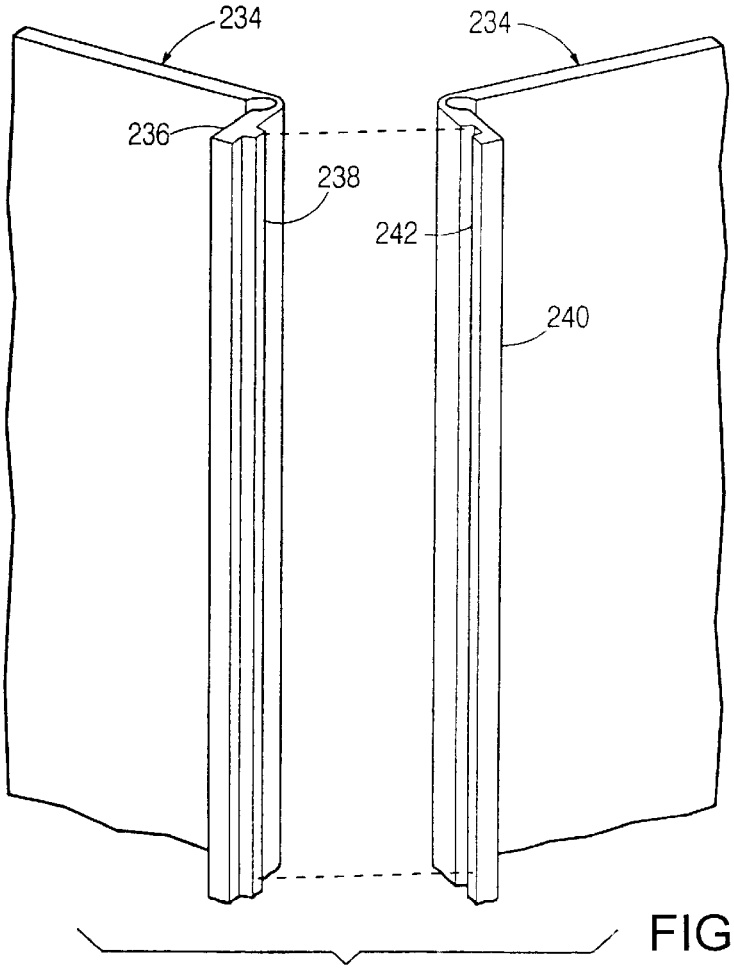
FIG. 6 is an exploded fragmentary perspective view of the pair of panels according to an alternative embodiment.
Figure 7:
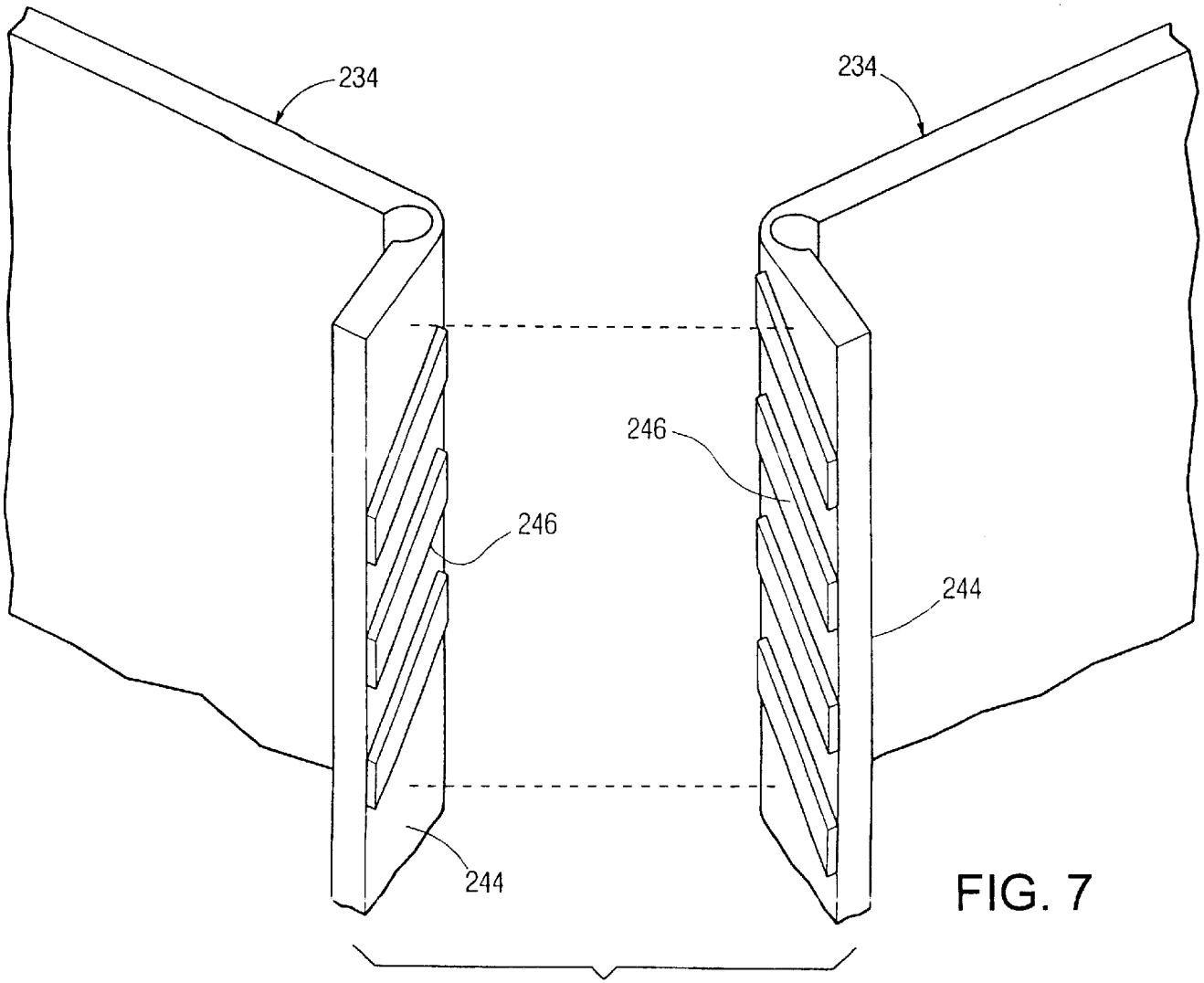
FIG. 7 is an exploded fragmentary perspective view of the pair of panels according to an alternative embodiment.

Referring to FIGS. 6 and 7, edge members 72 are provided with a variety of arrangements to provide a weather shield or reduce the transmission of light between panels. For example, as shown in FIG. 6, side panel 234 includes a first panel edge member 236 having a rib 238 (e.g. flange, fin, projections, etc.); and a second panel edge member 240 having a slot 242 configured to receive rib 238. Alternatively, as shown in FIG. 7, edge members 244 include a series of diagonal ribs 246 (e.g., flange, fin, projections, etc.) disposed at different relative vertical positions on adjacent edge members. According to alternative embodiments, side panel 68 includes an aperture (e.g., molded in, cut, etc.) so that a window may be installed. The window can be provided with modular enclosure or purchased later and installed by consumer.

Figure 5:
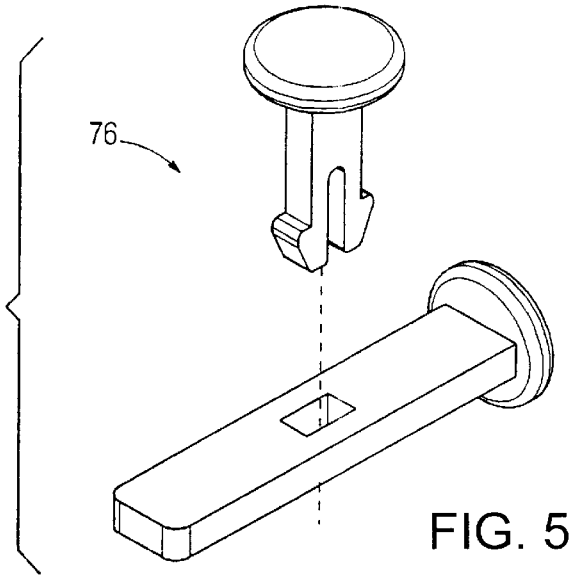
FIG. 5 is an exploded perspective view of a connector according to an exemplary embodiment.
Figure 10:
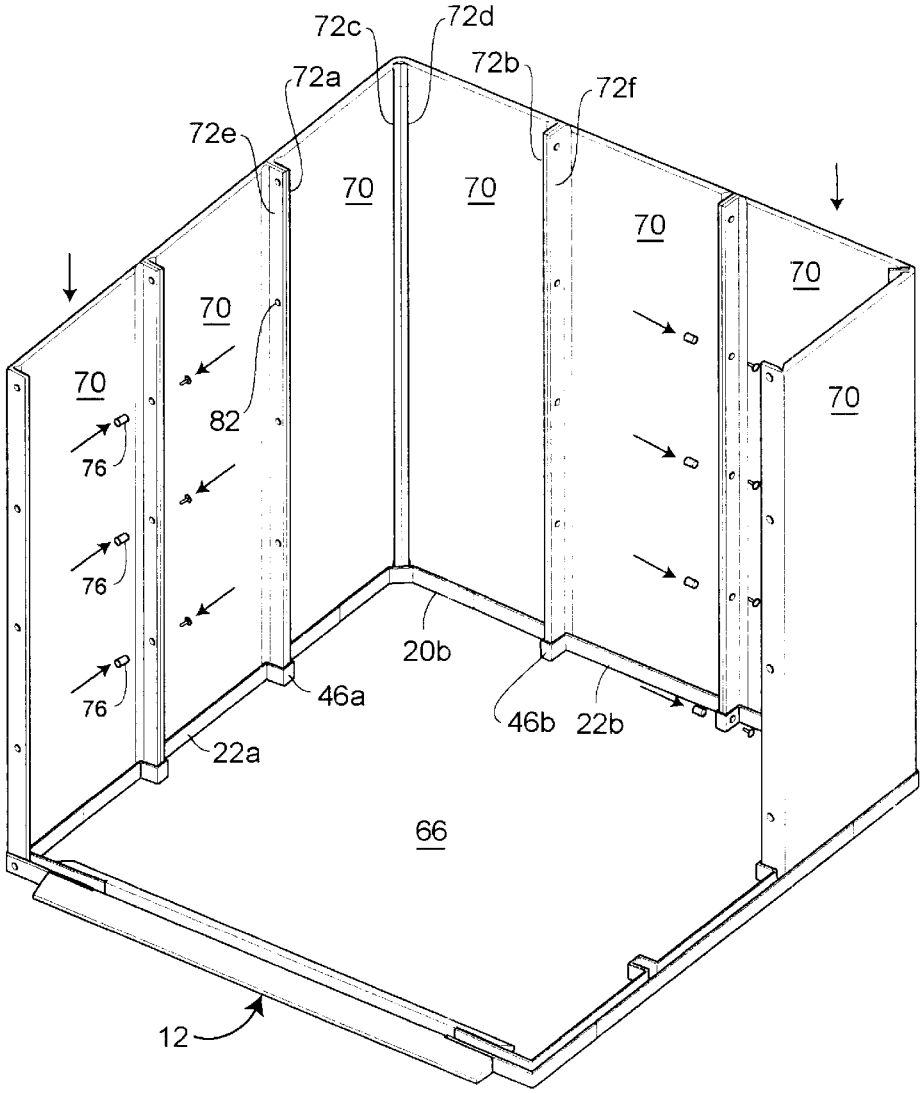
FIG. 10 is a perspective view of a partially assembled wall assembly for the modular enclosure of FIG. 1.

Referring to FIGS. 4 and 10, adjacent side panels 68*a*, 68*b* are coupled by a plurality of connectors 76 (e.g., one-piece connector, two-piece connector, pins, fasteners, etc.; see for example FIG. 5) inserted through apertures 78. Living hinge 74 is configured to allow edge member 72 to rotate across a large range of angles. As shown, edge member 72 is preferably rotated 90° or 135° relative to wall member 70 (about living hinge 74), depending on whether it is to form a corner of wall assembly 14 or a side—i.e., the adjacent side panels 68 are at a 90° angle or at abort a 0° angle relative to each other, respectively. Assembly of side panels 68 into a corner is preferably done by securing the edge members 72 with one or more connectors 76 before side panels 68 are rotated about living hinges 74 to its 90° position.

FIG. 4 is an exploded perspective view of the pair of side panels 68 of FIG. 3. According to a preferred embodiment, wall assembly 14 is assembled by first coupling two side panels 68, which form one of the rear base corners 20*b*, by engagement between side panels 68 and base corner 20*b* and base spacers 22. According to alternative assembly methods, the order of assembly of wall assembly 14 may be varied according to user's preference. When one user is assembling wall assembly 14, a corner is preferably assembled first (as shown in the FIG. 9).

Figure 9:
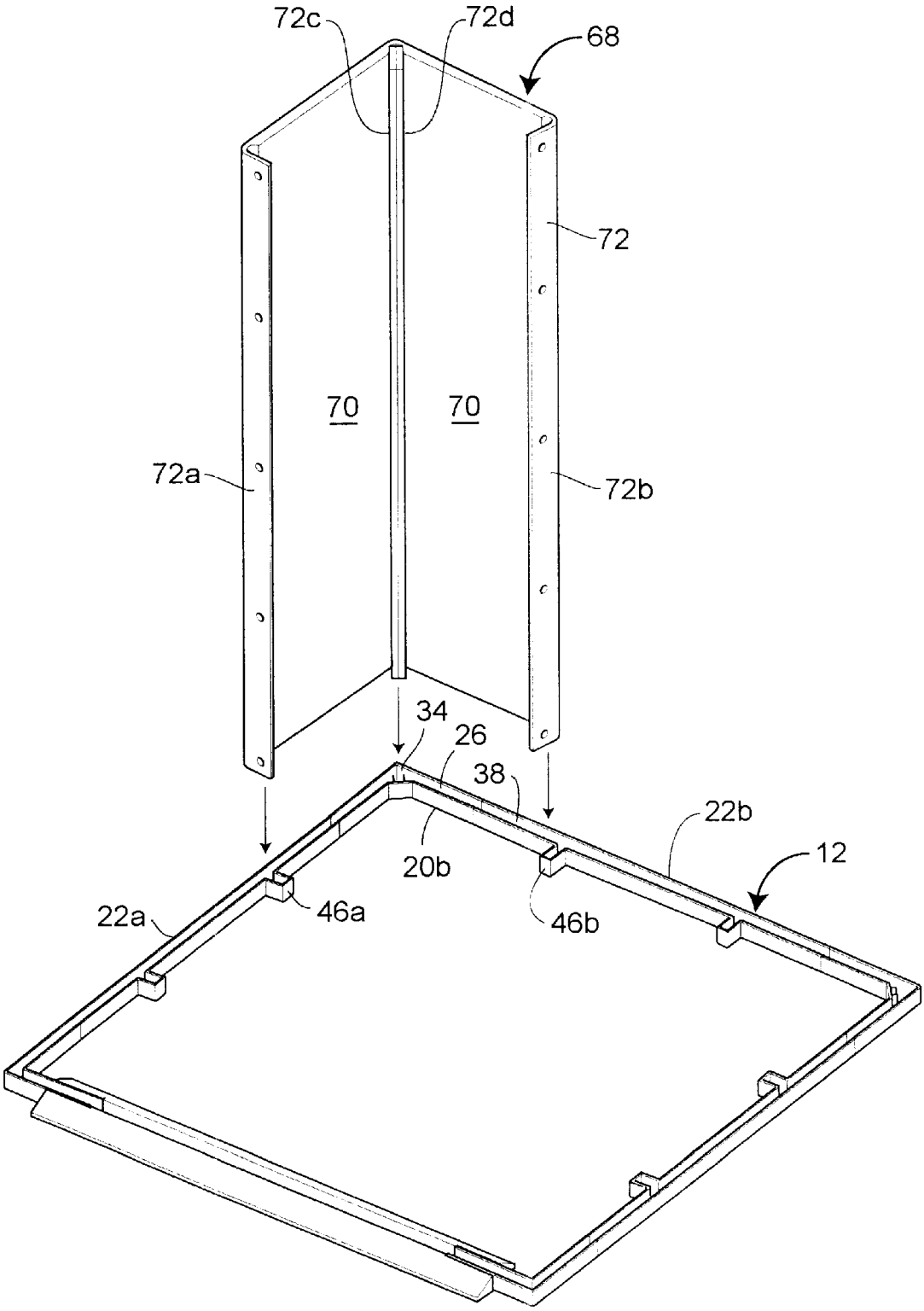
FIG. 9 is an exploded perspective view of the corner of FIG. 8 engaging the base of FIG. 2.

FIG. 9 is an exploded perspective view of the pair of side panels 68 of FIG. 8 and base 12 of FIG. 2. Rotated edge members 72*c* and 72*d* are configured to fit in socket 34 to form a secure engagement so that additional side panels 68 are engagable with base 12. According to preferred embodiments, sockets 34 of rear base corner 20*b* are configured to receive edge members 72*c* and 72*d* of side panels 68 in an approximately 45° position relative to wall members 70. As shown, the lower ends of adjacent side panels 68 engage channels 26, 38 and sockets 34, 46 of base corner 20*b* and base spacer 22, respectively. Edge members 72*a*, 72*b* engage sockets 46*a*, 46*b* of spacers 22*a*, 22*b*. Edge members 72*c*, 72*d* engage socket 34 of base corner 20*b*. According to alternative embodiments, the interface between the sockets and edge members 72 have any of a variety of angles, engagements (e.g., snap-fit), and the like.

FIG. 10 is an exploded perspective view of base section 12 and wall panels. As shown in FIG. 10, edge members 72*e*, 72*f* are disposed adjacent to edge members 72*a*, 72*b*, respectively, and are configured to engage sockets 46*a*, 46*b*. As shown, a connector 76 is inserted through apertures 80 in sockets 46 and apertures 82 in edge members 72 to secure side panels 68 to base 12. According to alternative embodiments, any of a variety of fastening techniques may be employed (e.g., fasteners, screws, bolts, rivets, clamps, etc.). Edge members 72 of side panels 68 nearest the entrance of modular shed are rotated 90° and engage channel of front base corner 20.

Figure 11:
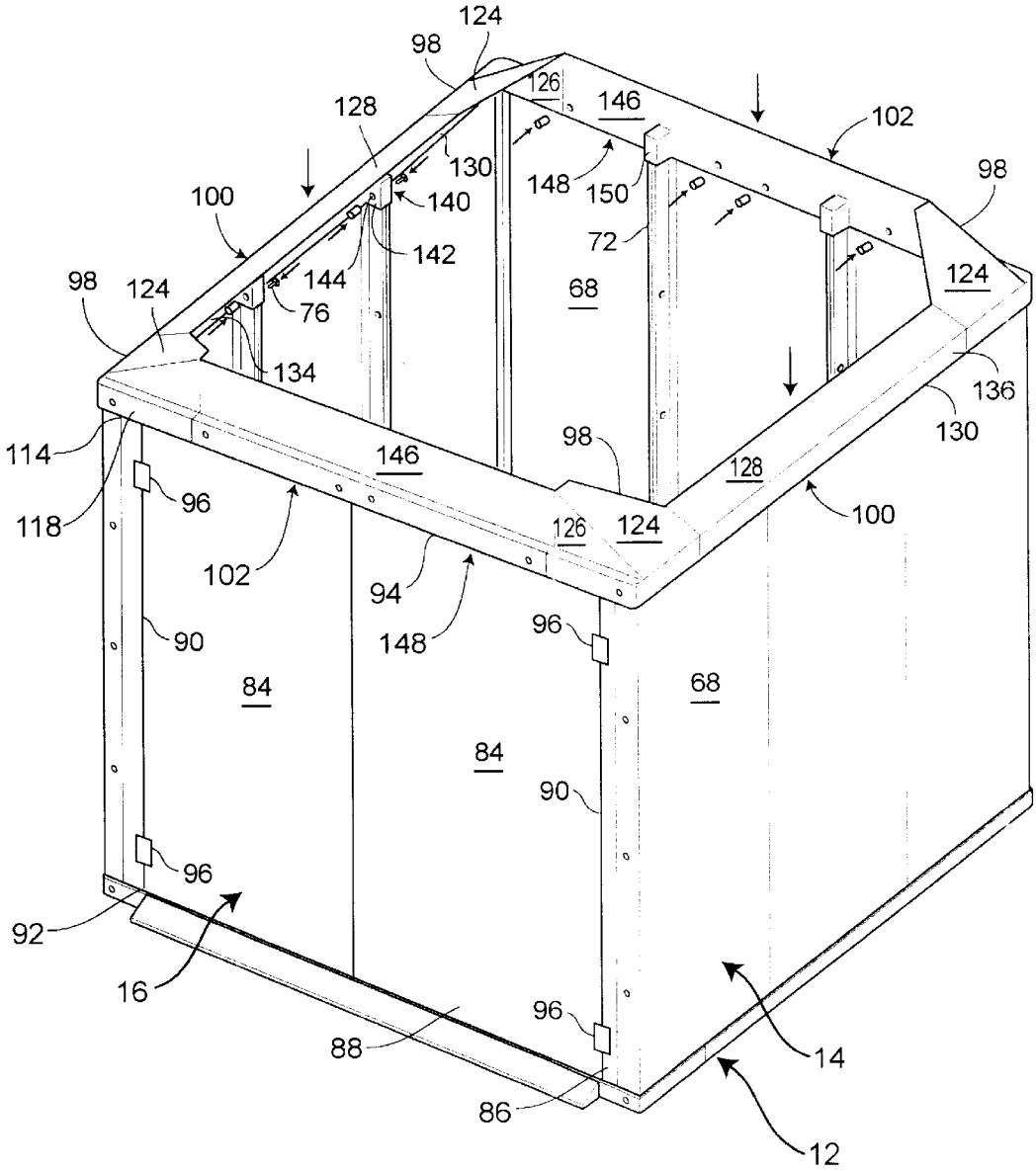
FIG. 11 is a perspective view of a partially assembled modular enclosure of FIG. 1.

Referring to FIG. 11, door assembly 16 is attached to base section 12 and wall panels 68. Door assembly 16 includes a pair of door sections 84 which include a frame 86, a door 88, and a handle. Frame 86 and door 88 are integrally molded and coupled by a living hinge 90. During manufacture, after door section 84 is formed (e.g., blow molded), door 88 and frame 86 are separated from each other at upper and lower seams 92, 94 (e.g., by a cutting operation that severs material that connects door 88 and frame 86). According to a preferred embodiment, a secondary hinge 96 also couples door 88 and frame 86 and is intended to provide additional strength and support for door and to serve as a weather shield to minimize water and wind passage.

Side edge member 72 is configured to overlap door sections 84. According to a preferred embodiment, edge members of side panel 68 are coupled to door assembly 16 with a device and an arrangement similar to that which is shown in FIG. 9 wherein two side panels 68 are coupled to front base corner 20*a* by an engagement between edge members 72 of side panels 68 and socket 34 of base corner 20.

FIGS. 11–13, 15, 17, and 18 also show roof assembly 18 being assembled and coupled to side panels 68 and door assembly 16. Roof assembly 18 includes a gusset or roof corner 98, roof spacers 100, headers 102, a front and rear gable 104, a ridge beam 106, a plurality of roof panels 108, a plurality of roof panels 110, and a ridge cap 112.

FIG. 11 is a perspective view of roof corners 98 attached to side panels 68. Each roof corner 98 includes a channel 114 that is generally U-shaped. Channel 114 is defined by a downwardly extending inner flange (not shown but similar to that which is shown for roof spacer 100) and outer flange 118 connected by a web (not shown but similar to that which is shown for rear base corner 20*b* in FIG. 2). Inner flange includes a roof corner socket (not shown but similar to that which is shown for rear base corner 20*b* in FIG. 2) formed by a plurality of ribs (not shown but similar to that which is shown for rear base corner 20*b* in FIG. 2). According to alternative embodiments, roof corner sockets are formed by any of a variety of arrangements such as slots molded or cut into inner flange, a series of integrally molded flanges, etc. Roof corner 98 further includes an angled surface 124 and a vertical surface 126 and is configured to provide support to roof panels 108.

FIG. 11 also shows roof spacers 100 and headers 102 coupled to side panels 68 or door sections 84. Roof spacers 100 include an angled surface 128, a channel 130, and sockets 140. Angled surface 128 has approximately the same slope or "pitch" as provided by angled surface 124 of roof corner 98. Angled surface 124 of roof corner 98 and angled surface of roof spacer may be coupled to roof panels 108 using a fastener such as a screw. Channel 130 is generally U-shaped and is defined by a downwardly extending inner flange 134 and a downwardly extending outer flange 136 connected by a web 138. Inner flange 134 includes a socket 140. Sockets 140 are defined by a plurality of downwardly extending flanges 142 and is configured to receive upper ends of side panels 68. Flanges 142 of sockets 140 include apertures 144 for connector 76 to couple roof spacer 100 to edge members 72 of side panels 68.

Headers 102 are configured to provide a structural surface above the entrance and the rear of modular enclosure 10. Each header 162 includes an upwardly extending flange 146, a channel 148, and a socket 150. Flange 146 extends to approximately the same height as roof corners 98. Socket 140 is configured to receive edge members 72 of side panels 68 which make up the side and rear structural elements of modular enclosure 10.

Figure 12:
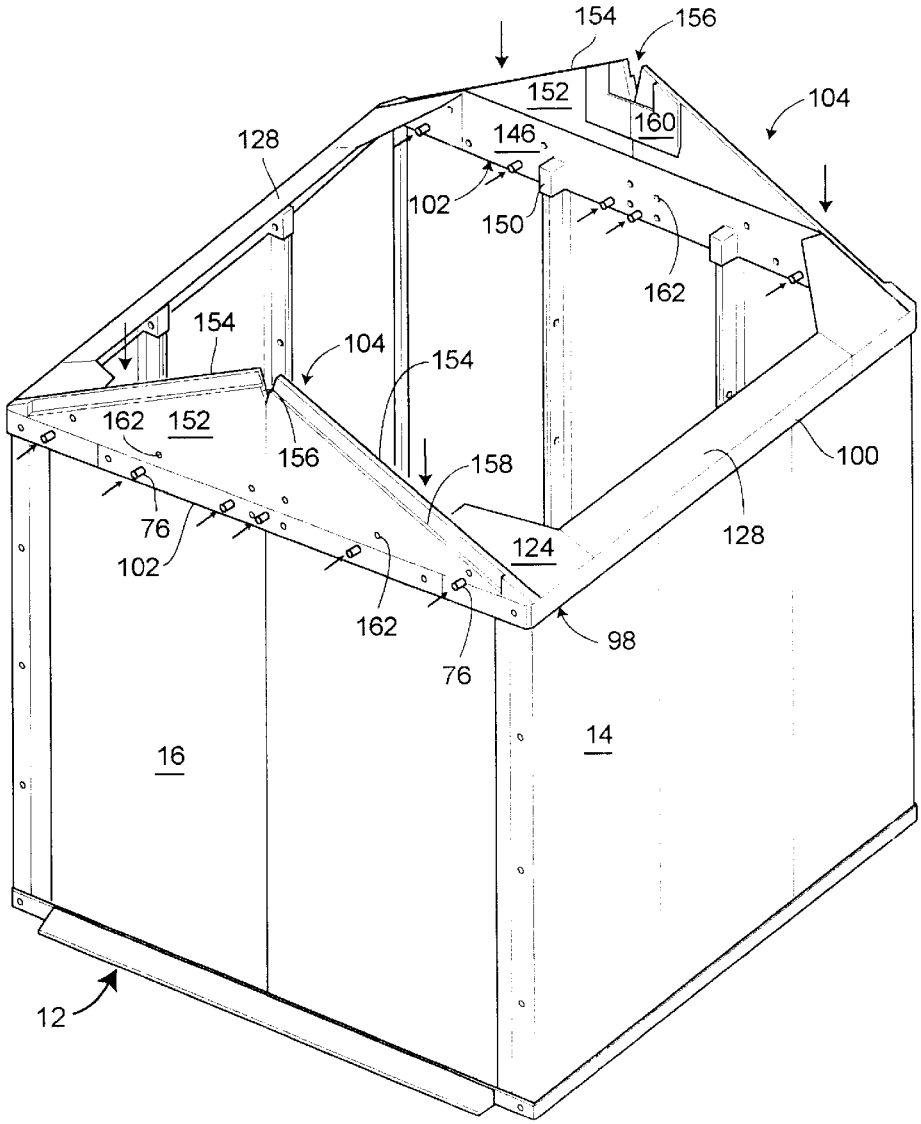
FIG. 12 is a perspective view of a partially assembled modular enclosure of FIG. 1.

FIG. 12 is an exploded perspective view of gables 104 being coupled to roof corners 98 and headers 102. Each gable 104 includes a front section 152, upper flanges 154, and a slot 156. Front section 152 and upper flanges 154 form a step 158 which is configured to receive and support roof panels 110. Slot 156 is disposed between upper flanges 154, and configured to receive ridge beam 106. A raised portion 160 is disposed about slot 156 and is configured to provide structural support for ridge beam 106 and assist in positioning and locating ridge beam 106 in slot 156. Gables 104 are attached to headers 102 and roof corners 98 by a plurality of fasteners or a plurality of connectors 76 disposed within apertures 162. According to an alternative embodiment, gables 104 are made from a pair of sections as shown in FIG. 12.

Figure 13:
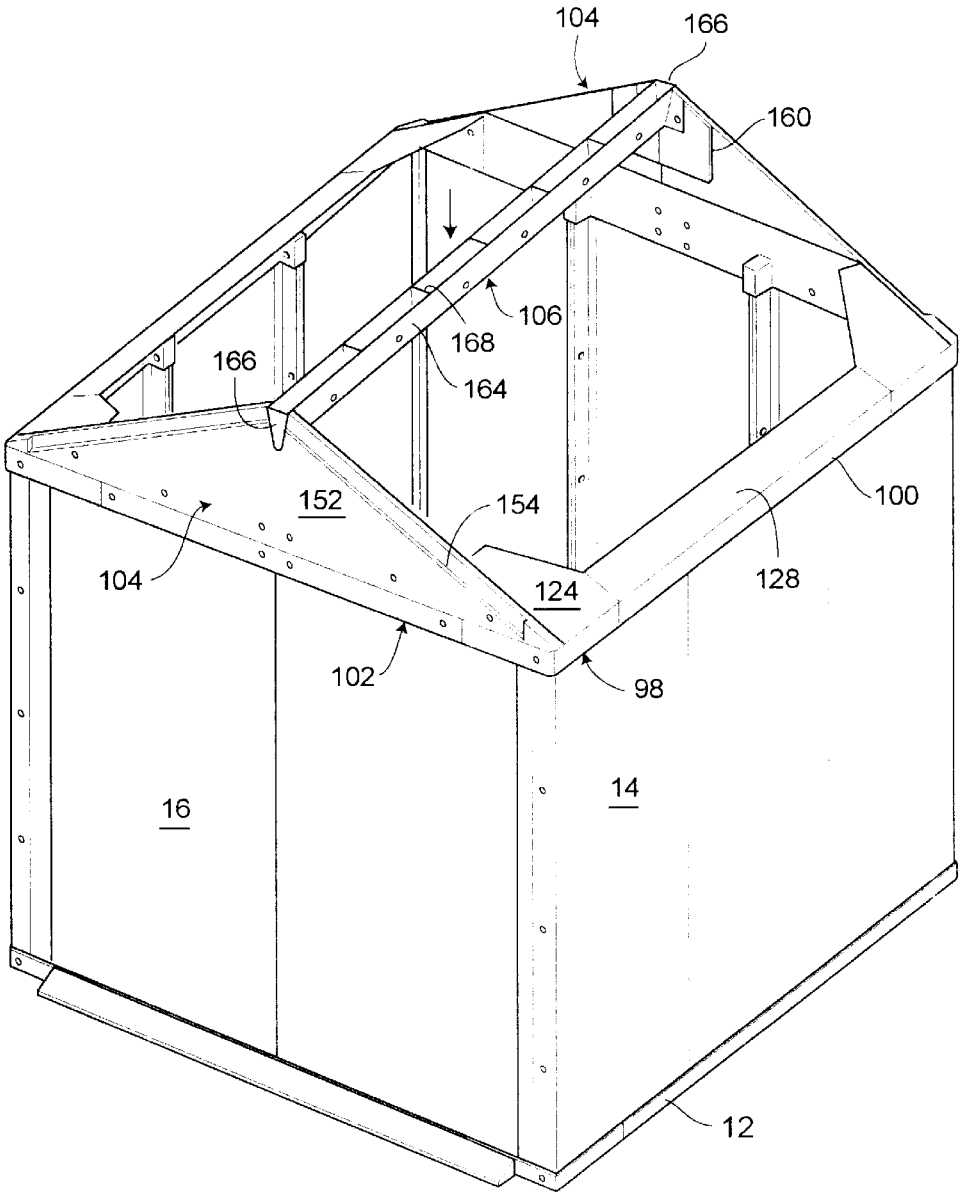
FIG. 13 is a perspective view of a partially assembled modular enclosure of FIG. 1.

Referring to FIG. 13, ridge beam 106 is coupled to front and rear gables 104 by connectors 76 or fasteners (not shown). Ridge beam 106 includes support walls 164 which are spaced apart by end caps 166 and spacers 168. As shown, walls 164 are angled for draft to facilitate the manufacture of ridge beams 106. According to alternative embodiments, walls 164 have any of a variety of angles and orientations including an arrangement wherein walls 164 are substantially vertical. End caps 166 are designed to be disposed within the area defined by raised portion of gables 104.

Figure 14:
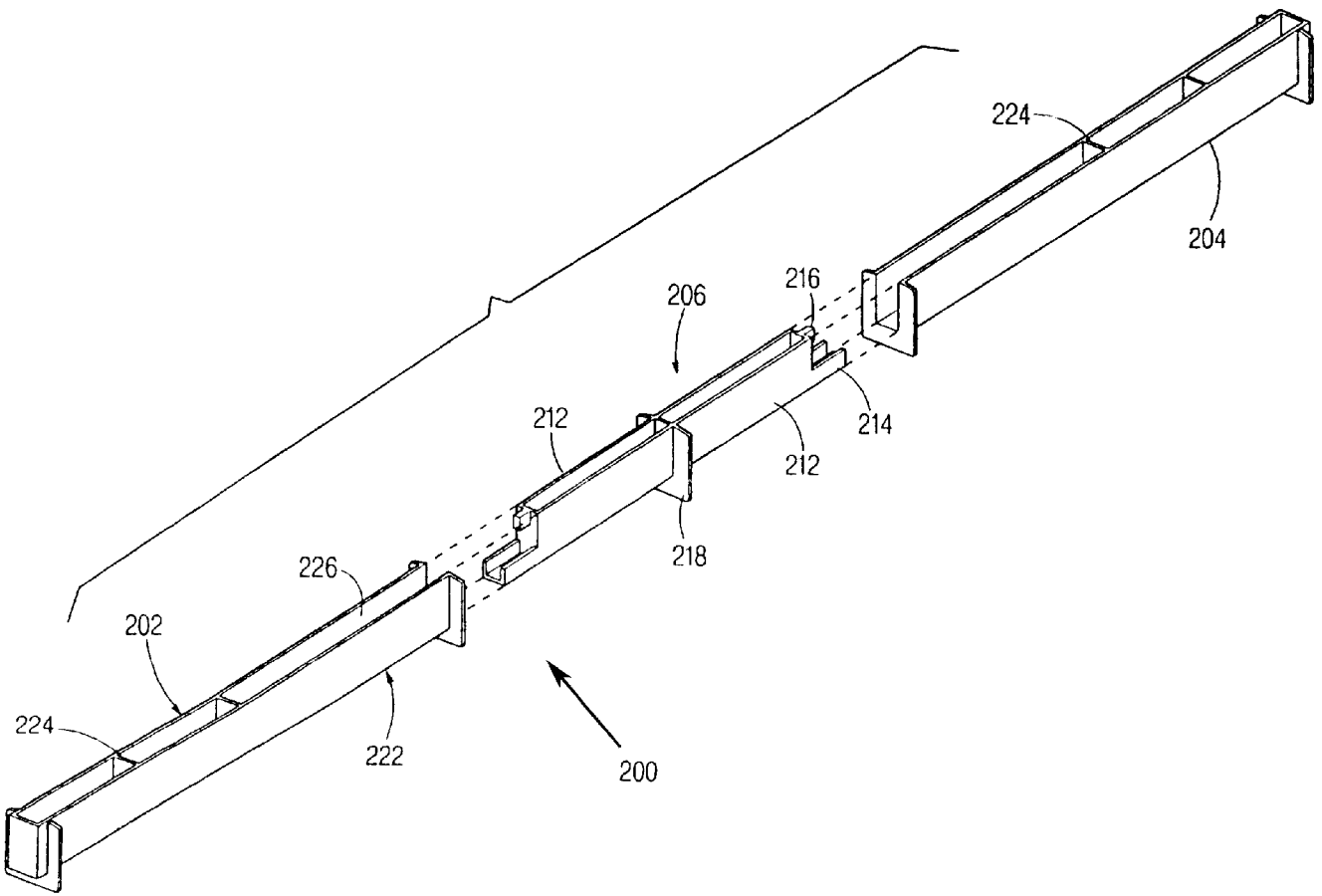
FIG. 14 is an exploded perspective view of a ridged beam according to an exemplary embodiment.

According to an alternative embodiment shown in FIG. 14, a ridge beam assembly 200 is made from two beam sections 202, 204 engaged by an overlapping configuration with a center section 206. Such a configuration is preferred for relatively long modular enclosures wherein the length of the ridge beam may cause problems for handling, shipping, transportation, storing, molding, manufacturing, fabricating, etc. Center section 206 is provided for additional structural support and to provide a variable number of arrangements with regard to dimensional aspects of ridge beam assembly 200. Center section 206 includes spaced apart walls 212, a lower horizontally extending member 214, an upper horizontally extending projection or member 216, and a middle rib or wall 218. Beam sections 202, 204 each receive one-half of center section 206. A lower notch 222 in spacer 224 receives lower horizontally extending member 214, and an upper notch 226 receives upper horizontally extending member 216. Connector 76, a pin, fastener, or the like, couples beam sections 202, 204 and center section 206. Such an engagement of center section 206 and ridge beams 202, 204 is intended to provide additional strength and resistance against flexing of the assembled ridge beam assembly 200. According to an alternative embodiment, ridge beams assembly 200 are configured to engage using a similar notch and horizontally extending member arrangement without the use of center section 106.

Figure 15:
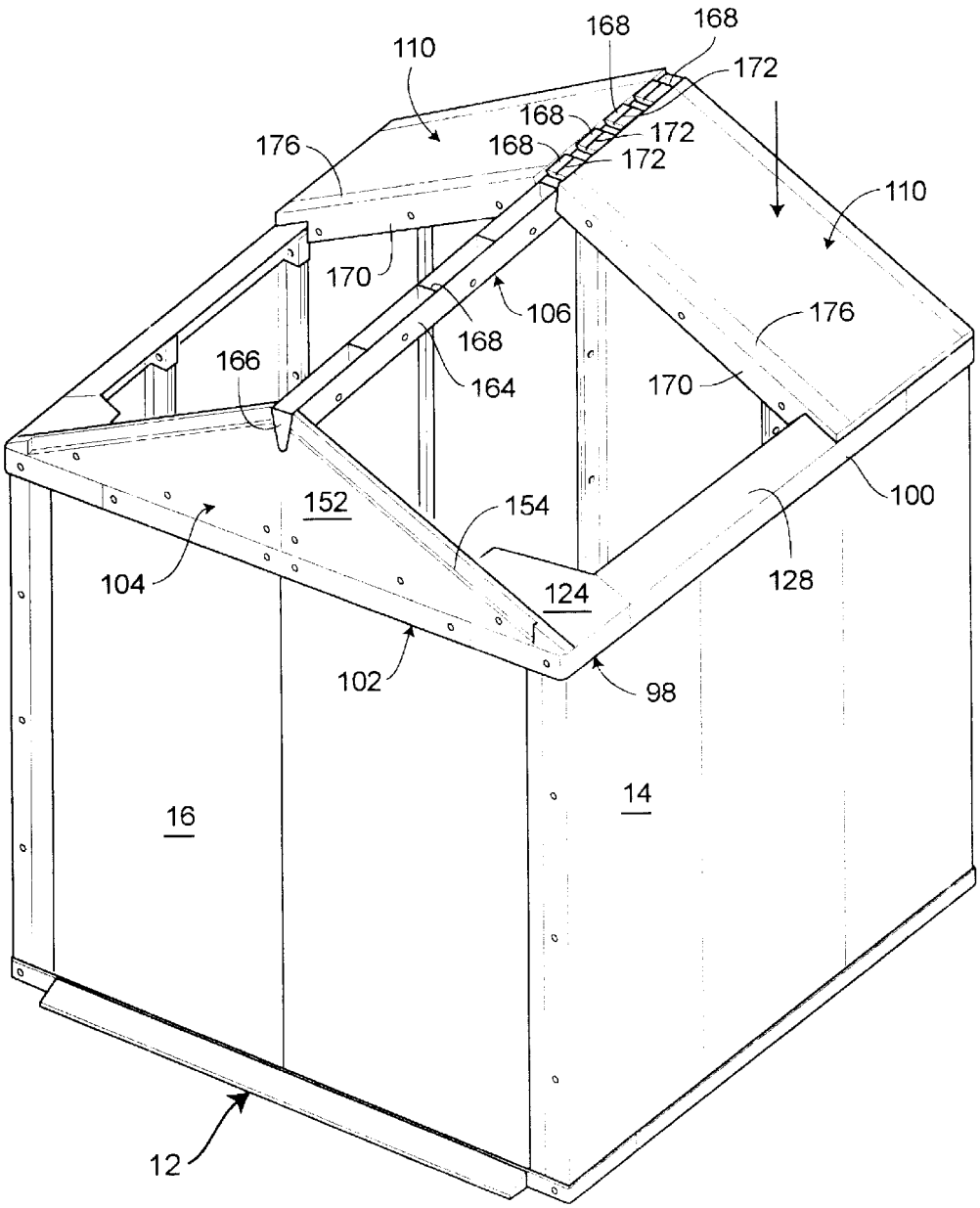
FIG. 15 is a perspective view of a partially assembled roof assembly for the modular enclosure of FIG. 1.

FIG. 15 is an exploded perspective views of roof panels 110 being coupled to ridge beam 106, roof spacers 100, roof corners 98, and gables 104. Roof panels 110 include a pair of roof panel tabs 168 and downwardly extending flanges 170.

Roof panel tabs 168 extend from the upper end of roof panel 110 and are positioned on ridge beam 106. According to alternative embodiments, roof panel tabs 168 may be coupled to ridge beam 106 with connectors 76, fasteners, brackets, etc. Roof panel tabs 168 are configured to provide an alternating arrangement when opposing roof panels 110 are added to roof assembly 18 (see for example FIG. 15). Roof panel tabs 168 include a slot 172 configured to receive a rib 174 of ridge cap 112. According to a preferred embodiment, downwardly extending flange 170 of each roof panel 110 is disposed between walls 164 of ridge beam 106 and angled surface 128 of roof spacers 100 or between walls 164 of ridge beam 106 and angled surface 124 of roof corner 98.

Edges of roof panels 110 adjacent downwardly extending flanges 170 include a raised portion 176 to inhibit water or other elements from entering the interior of modular enclosure 10 and to channel water off of roof section. Edges of the roof panels 110 mounted above the entrance and rear wall engage the stepped structure of gables 104, and are connected to gables 104 with fasteners, connectors, etc.

Figure 17:
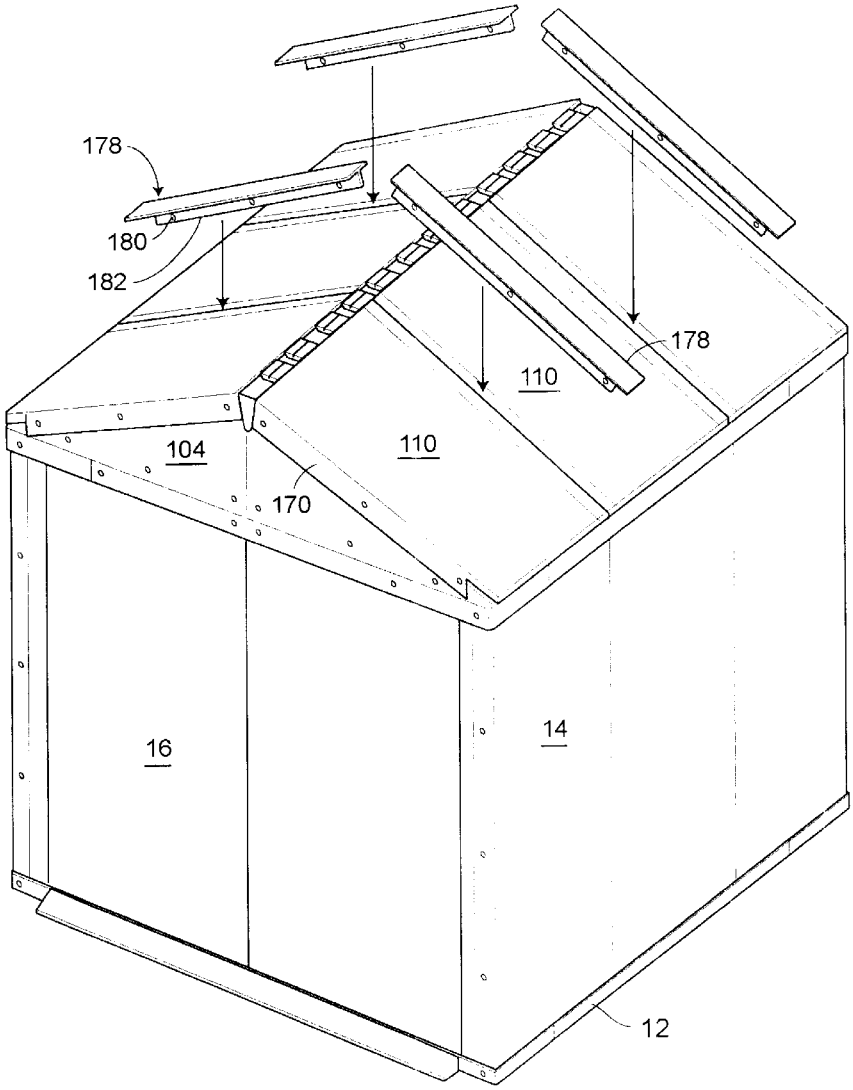
FIG. 17 is a perspective view of a partially assembled roof assembly for the modular enclosure of FIG. 1.
Figure 18:
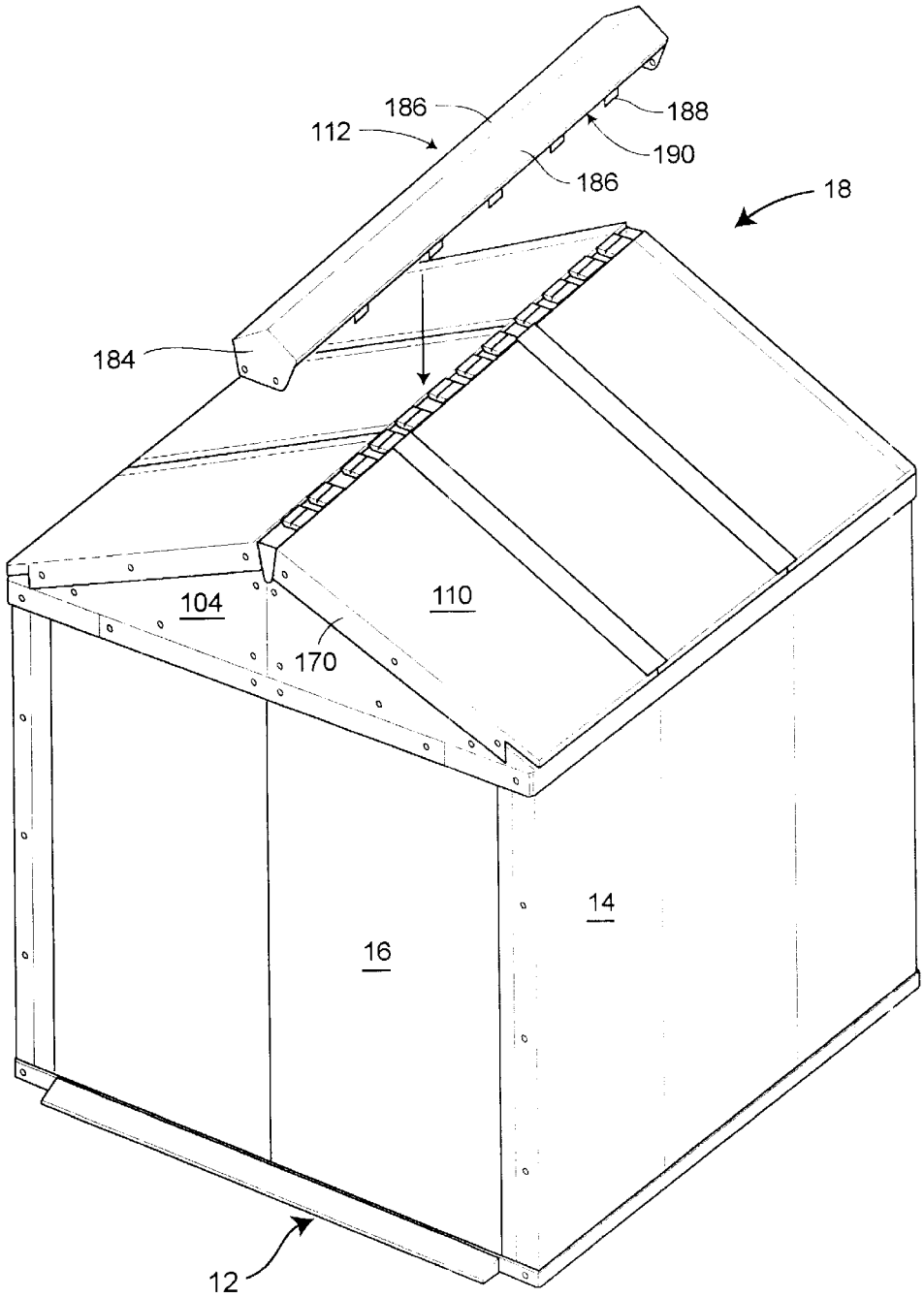
FIG. 18 is a perspective view of a partially assembled roof assembly for the modular enclosure of FIG. 1.

As shown in FIGS. 17 and 18, a plurality of T-shaped roof beams or members 178 are inserted between adjacent roof panels 110 to provide additional structural support and to deflect water from the space between adjacent roof panels 110. Adjacent roof panels 110 are coupled by fasteners or connectors 76 disposed within apertures 180 in roof flanges 170 of roof pane's 110 and middle flange 182 of roof members 178.

Figure 16:
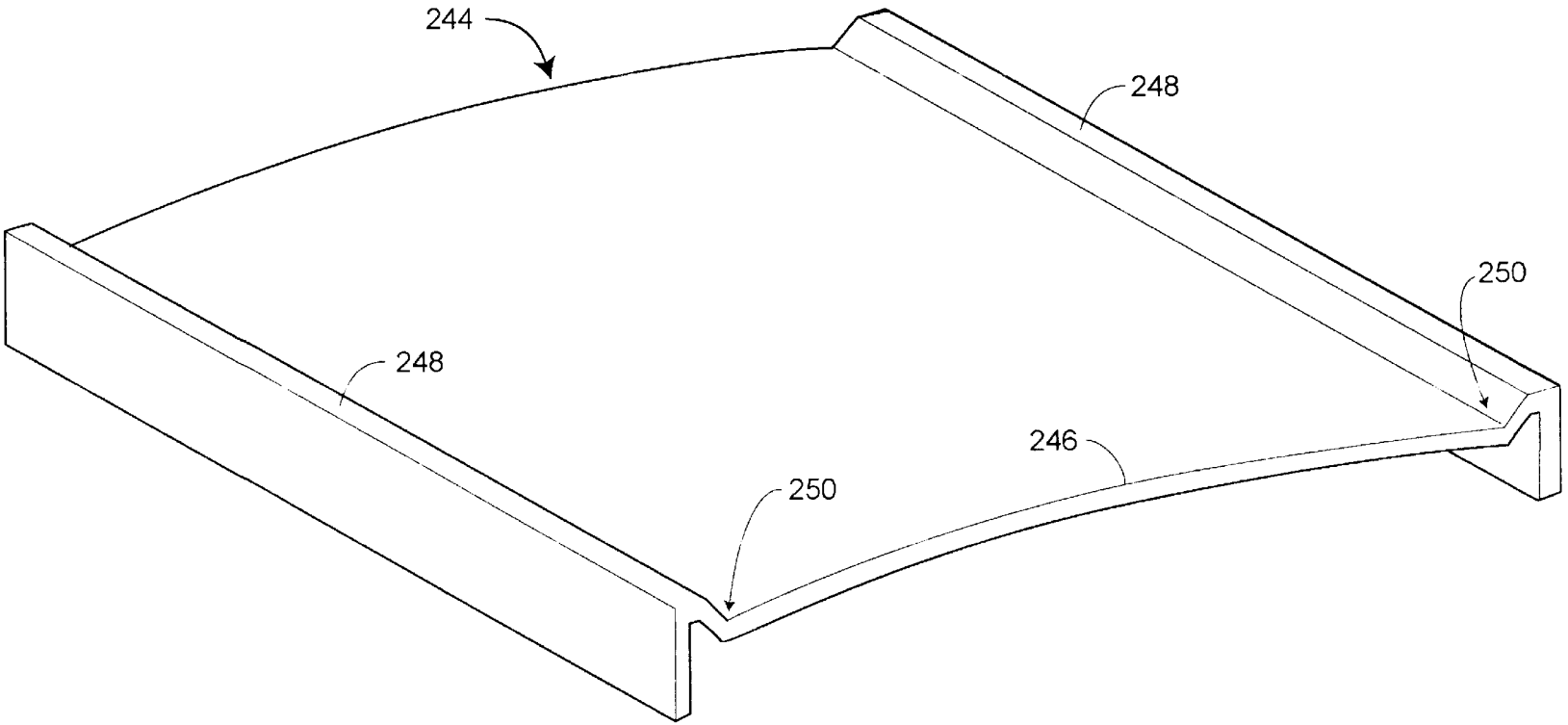
FIG. 16 is a perspective view of a roof panel according to an alternative embodiment.

Referring to FIG. 16, roof panel 244 includes a curved section 246 intermediate side flanges having raised portions 248 so that roof panel 244 "flattens" when placed under a load of a downward force (e.g., weight of snow). The interface between the ends of curved section 246 and raised portions 248 provide a channel 250 for draining water from roof panel 244.

As shown in FIG. 18, ridge cap 112 includes end caps 184, angled members 186 disposed between end cap 184, a plurality of downwardly extending fins 188 extending from the underside of angled members 186, and downwardly extending ribs 190 also extending from the underside of angled members 186. Ridge cap 112 is coupled to roof panels 110, gables 104, and ridge beam 106 by engagement of plurality of downwardly extending fins 188 inserted into ridge beam and between alternating adjacent roof members. Also, downwardly extending ribs 174 engage slots 172 in roof panel tabs 168 of roof panels 110. End caps 184 are coupled to gables 104 with connectors 76 or fasteners.

As described herein, the side panels 68, roof panels 110, gables 104, and door section 184 are double-wall hollow components made from blow molded high density polyethylene. Base corner 20*a*, 20*b*, base spacers 22, threshold 24, roof corners 98, roof spacers 100, headers 102, gables 104, ridge beam 106, roof members 178, and ridge cap 112 are made of structural foam such as high density polyethylene combined with a chemical blowing agent. According to alternative embodiments, these components may be molded from a variety of plastics or fabricated from a variety of metals.

Figure 19:
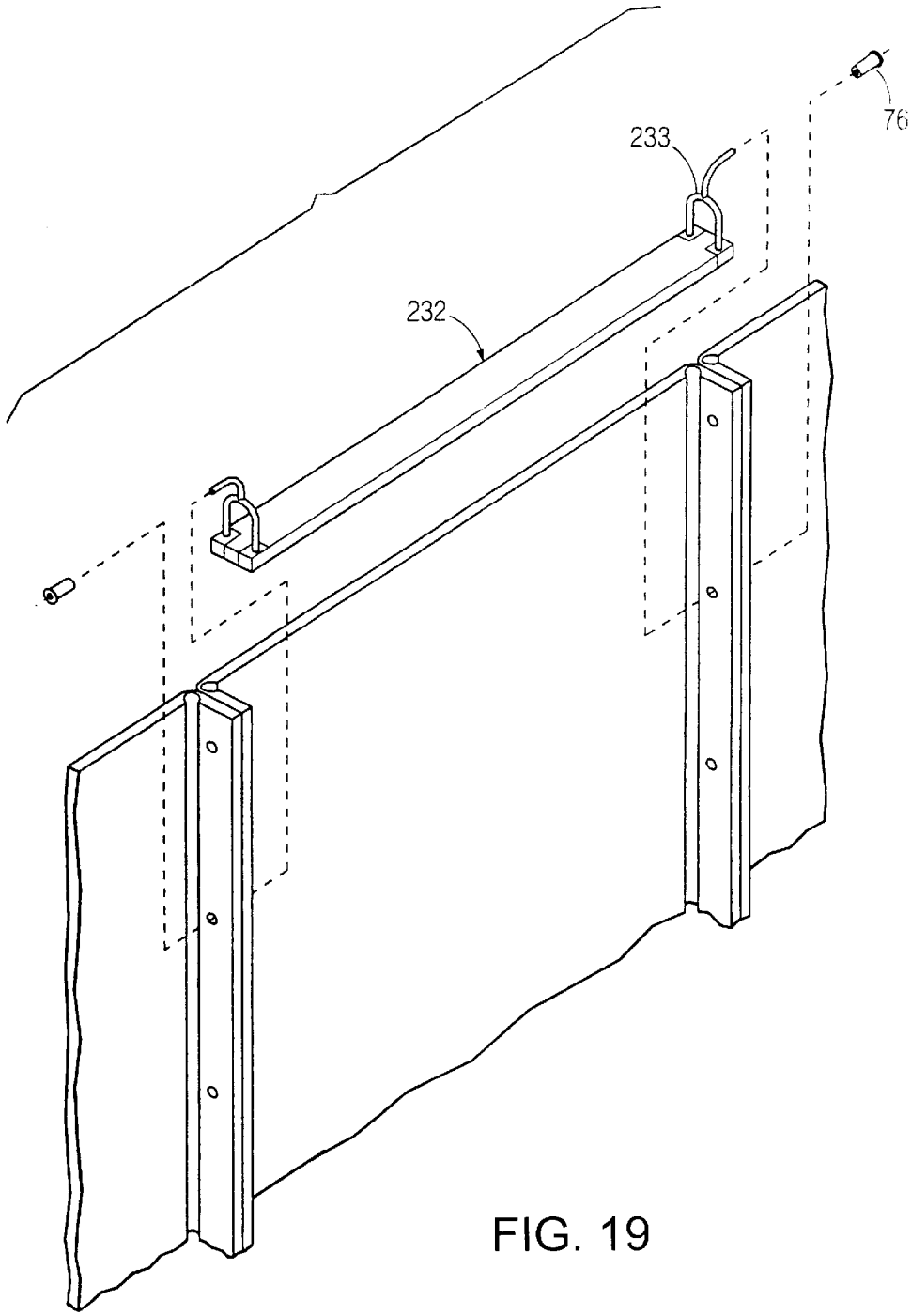
FIG. 19 is an exploded fragmentary perspective view of an accessory for the modular enclosure according an exemplary embodiment.

Referring to FIG. 19, accessories may be provided to increase the functionality and utilization of the modular enclosure. For example, a shelf 232 is coupled to the interior of the modular enclosure 10 using brackets 233 or any of a variety of fastening arrangements (e.g., with fasteners, molded or cut slots, etc.). Alternatively, any of a variety of accessories may be coupled to wall assembly 14 by interfacing with apertures in edge members 72 and side panel 68.

It will be understood that the foregoing description is of preferred exemplary embodiments of this invention, and that the invention is not limited to the specific forms shown. It is also important to note that the construction and arrangement of the elements of the modular storage enclosure as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the mounting interfaces for accessories may be used in a panel that is mounted on a wall (e.g., near a workbench, in an office environment, at a work site, or in other industrial or institutional environments). Also, a panel with the mounting interfaces may be used individually as a separate, stand alone structure. Further, it is important to note that the terms "storage enclosure," "interface," and "accessories," are intended to be broad terms and not terms of limitation. The interfaces and connectors may be used with any of a variety of products or arrangements and are not intended to be limited to use with storage enclosures or sheds, but are intended to be used with any arrangement where modular, selective, or custom configuration or coupling is employed. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions as expressed in the appended claims.

What is claimed is:

1. A modular enclosure comprising:

a base including a channel and at least one socket arranged non-parallel to the channel;

a plurality of panels, each including a wall member and at least one edge member pivotally connected to the wall member;

wherein the wall members are configured to engage the channel and adjacent edge members are configured to engage the at least one socket such that the adjacent edge members are arranged non-parallel to the wall members.

2. The modular enclosure of claim 1 wherein the channel is defined by a pair of generally parallel walls extending from the base.

3. The modular enclosure of claim 1 wherein the at least one socket is defined by a pair of generally parallel walls extending from the base.

4. The modular enclosure of claim 1 wherein the at least one edge member is rotated to engage the at least one socket.

5. The modular enclosure of claim 1 wherein the at least one socket extends approximately perpendicularly from the channel and the at least one edge member is rotated about 90° to engage the at least one socket.

6. The modular enclosure of claim 1 wherein the base further includes a corner socket, and the at least one edge member is rotated about 135° to engage the corner socket.

7. The modular enclosure of claim 1 wherein the base includes a plurality of sockets and a plurality of spacers, and the sockets intersect the spacers.

8. The modular enclosure of claim 1 wherein the panels include a plurality of spaced-apart diagonal ribs.

9. The modular enclosure of claim 1 wherein the plurality of panels further include a living hinge that couples the at least one edge member to the wall member.

10. The modular enclosure of claim 1, further including a roof assembly including a pair of gables mounted at opposing ends of the modular enclosure, a ridge beam coupled to the gables, a plurality of roof panels at least partially supported by the ridge beam, and a ridge cap having one or more fins configured to engage the roof panels and the ridge beam.

11. The modular enclosure of claim 1 further including a plurality of connectors to couple the at least one edge members of adjacent panels.

12. The modular enclosure of claim 1 wherein the at least one edge member includes a slot, and each panel further includes a second edge member having a rib configured to engage the slot of an adjacent at least one edge member.

13. The modular enclosure of claim 12 wherein the rib is diagonal.

14. A modular enclosure comprising:

a base including channels and sockets intersecting the channels;

a plurality of panels, each panel including a wall member, a first edge member, and a second edge member, wherein the wall member has a first side and a second side, and the first edge member is pivotally coupled to the first side and the second edge member is pivotally coupled to the second side;

wherein the wall members engage the channels and the edge members engage the sockets.

15. The modular enclosure of claim 14, further including a pair of gables mounted at opposing ends of the modular enclosure, a ridge beam coupled to the gables, a plurality of roof panels at least partially supported by the ridge beam, and a ridge cap having one or more fins configured to engage the roof panels and the ridge beam.

16. The modular enclosure of claim 15 wherein the ridge beam includes a first section and a second section, the first section engaged with one of the gables at one end and the second section at the other end, the first section having a pair of spaced-apart sidewalls and a rib connecting the spaced-apart sidewalls, the second section including an upper projection and a lower projection, the upper projection being configured to engage an upper notch of the rib and the lower projection being configured to engage a lower notch of the rib, wherein engagement of the upper and lower projections with the upper and lower notches is configured to inhibit pivotal movement of the first and second sections relative to each other.

17. The modular enclosure of claim 15 wherein each roof panel includes a convex surface with opposed edges having downward extending flanges and raised portions, wherein the flange and convex surface interface forms a channel.

18. The modular enclosure of claim 14 wherein the base includes at least one corner socket, and the edge members of adjacent panels are rotated about 135° to engage the at least one corner socket.

19. The modular enclosure of claim 14 wherein the base includes at least one corner socket, the first edge member of a panel is rotated about 90° to engage the socket, and the second edge member of the panel is rotated about 135° to engage the corner socket.

20. The modular enclosure of claim 14, further including an accessory coupled to at least one edge member.

21. The modular enclosure of claim 20, wherein the accessory is a shelf.

22. The modular enclosure of claim 14 wherein the panel includes a first living hinge that couples the first edge member to the wall member, and a second living hinge that couples the second edge member to the wall member.

23. The modular enclosure of claim 14, wherein each socket is approximately perpendicular to the channel and the edge members are rotated about 90° from their respective wall members to engage the sockets.

24. A method of assembling a modular enclosure, the method comprising:

providing a base including a first channel, a second channel, and a third channel;

providing a plurality of side panels each having a wall member and a first and second edge members pivotally coupled to the wall member;

pivoting the first and second edge members so that they are nonparallel to the wall member;

inserting the wall members into the first channel, the first edge member into the second channel, and the second edge member into the third channel.

25. The method of claim 24 further including the steps of:

providing a pair of gables, a ridge beam, and a plurality of roof panels each having a pair of spaced apart tabs;

mounting the ridge beam to the gables and positioning the roof panels so that the first and second tabs rest on the ridge beam, wherein tabs on opposed adjacent roof panels are positioned in an alternating arrangement.

26. The method of claim 25 further including the steps of:

providing a ridge cap having a first set of downwardly extending fins and set of downwardly extending fins;

coupling the ridge cap to the ridge beam; wherein the first set of extending fins engage grooves in the tabs and the second set of extending fins engage slots defined by adjacent tabs.

27. The method of claim 24 further including the steps of rotating the first edge member about 90° relative to the wall member to engage the second channel, and rotating the second edge member about 135° relative to the wall member to engage the third channel.

28. The method of claim 24 wherein the first edge members of adjacent side panels are inserted into the same second channel.

29. The method of claim 28 further including the step of coupling the adjacent edge members with a connector.

* * * * *

UNITED STATES PATENT AND TRADEMARK OFFICE

CERTIFICATE OF CORRECTION

PATENT NO. : 6,581,337 B1
DATED : June 24, 2003
INVENTOR(S) : Erik L. Skov et al.

It is certified that error appears in the above-identified patent and that said Letters Patent is hereby corrected as shown below:

Column 12,
Line 16, please insert -- a second -- before "set of downwardly".
Lines 18 and 19, please insert -- downwardly -- after "set of".

Signed and Sealed this

Eighth Day of March, 2005

JON W. DUDAS
*Director of the United States Patent and Trademark Office*